US005120042A

United States Patent [19]

Goto et al.

[11] Patent Number: 5,120,042

[45] Date of Patent: Jun. 9, 1992

[54] DOCUMENT SHEET FEEDER

[75] Inventors: Chikado Goto, Ibaraki; Hiroshi Tobita; Tetsuya Tamura, both of Omiya, all of Japan

[73] Assignee: Ikegami Tsushinki Co., Ltd., Tokyo, Japan

[21] Appl. No.: 367,946

[22] Filed: Jun. 19, 1989

[30] Foreign Application Priority Data

Jun. 22, 1988 [JP] Japan ..... 63-152408

[51] Int. Cl.[5] ..... B65H 3/06

[52] U.S. Cl. ..... 271/117; 271/120; 271/121

[58] Field of Search ..... 271/117, 118, 119, 120, 271/121

[56] References Cited

U.S. PATENT DOCUMENTS

| | | | |
|---|---|---|---|
| 3,630,516 | 12/1971 | Hong | 271/117 |
| 3,649,003 | 3/1972 | Muller | 271/120 |
| 3,731,915 | 5/1973 | Guenther | 271/119 |
| 4,192,497 | 3/1980 | Perun | 271/121 X |
| 4,394,009 | 7/1983 | Bergman | 271/119 X |
| 4,566,684 | 1/1986 | Gysling | 271/117 |

FOREIGN PATENT DOCUMENTS 44611 11/1987 Japan .

*Primary Examiner*—Richard A. Schacher
*Attorney, Agent, or Firm*—Oliff & Berridge

[57] ABSTRACT

A document sheet feeder in accordance with the present invention includes a document sheet stacker, an inclined surface portion which is inclined by a predetermined angle with respect to the document sheet stacker, a separation roller which is disposed above the document sheet stacker and which has a plurality of equiangularly-spaced-apart blades extending radially outwardly from the outer surface of the separation roller, a feed roller disposed downstream of the separation roller in order to feed a separated sheet to a predetermined position and pinch roller movable to contact with or disengage from the feed roller. The separation roller is rotatably carried at the end of a first swinging arm and is moved between an operative position at which the sheet separation is effected and an inoperative position spaced apart from the operative position. A pinch roller is rotatably carried at the leading end of a second swinging arm which in turn is swung to a position at which the pinch roller is made into contact with the feed roller when the separation roller is in the operative position for separating a sheet one at each time.

19 Claims, 7 Drawing Sheets

130E
130C
130F
130E
130C
130E
130D
130A
130C
130B
130
130D

DOCUMENT SHEET FEEDER

BACKGROUND OF THE INVENTION

1. Field of the Invention

The present invention relates to a document sheet feeder and more particularly to a document sheet feeder used with a copying machine, a facsimile or the like so as to feed sequentially document sheets set on a document sheet stacker one for each time to a predetermined position.

2. Description of the Prior Art

In general a document sheet feeder which is used with a copying machine, a facsimile or the like must separate one sheet for each time from a stack of sheets set on a document sheet stacker in a positive manner and feed the sheet thus separated to a predetermined position within a short period of time.

Furthermore, document sheet feeders are generally used in office rooms or the like so that they are required not to produce noise.

Conventionally, various types of document sheet feeders of the type described above have been disclosed and demonstrated. For instance, Japanese Utility Model Publication No. 62-44611 (1987) discloses a document sheet feeder of the type in which a separation pawl having a tapered portion for abutting to the leading edge of a sheet is arranged in opposing relationship to a separation roller. A flexible brake plate made of rubber is disposed behind the separation pawl so that a lowermost sheet of a stack of sheets is separated and fed.

In another document sheet feeder, elastic members in the form of a semi-cylinder are attached at opposite ends of rod-shaped member so that upon rotation of the latter about the center of the member, the semi-cylindrical elastic members separate an uppermost sheet from a stack of sheets and feed it to a predetermined position.

Furthermore, in general, in order to maintain the separated sheet fed to a predetermined position for the sake of the post processing, a one way clutch or the like is used to interrupt the feed of the sheet in conventional sheet feeders.

However, in the first mentioned conventional sheet feeder, the separation roller made of rubber is used so that noise produced is negligible, but the brake plate is so designed and constructed as to contact with the sheets which have not been fed yet so that there arises problems that each sheet cannot be positively separated from the remainings and consequently a plurality of sheets are separated and fed at one time.

In the case of the second-mentioned conventional document sheet feeder, the semi-cylindrical elastic members are made into contact with one surface of a sheet so that the sheet is fed by frictional forces of the semi-cylindrical elastic members. As a result, the separation of each sheet from a stack of sheets can be relatively satisfactorily carried out, but there is a problem that high-level noise is produced when the semi-cylindrical elastic members contact with the surface of the sheet.

Furthermore, in the conventional sheet feeder which uses a one way clutch to interrupt a feed of a sheet, there arises problems that those mechanisms are complicated so as to be expensive, and it is not easy to remove jammed sheets.

SUMMARY OF THE INVENTION

One of the objects of the present invention is therefore to provide a document sheet feeder which can substantially solve the problems encountered in the conventional document sheet feeders and can positively separate a sheet from a stack of sheets at each time without producing noise.

Another object of the present invention is to provide a document sheet feeder which is simple in mechanism and inexpensive to manufacture and which can easily remedy various accidents such as jamming of sheets.

To the above and other ends, according to one aspect of the present invention, a document sheet feeder is characterized by comprising a document sheet stacker upon which are stacked a plurality of document sheets, an inclined surface portion inclined at a predetermined angle with respect to the document sheet stacker, a separation roller which is disposed above the document sheet stacker and which has a plurality of equiangularly-spaced-apart elastic blades each in the form of a loop disposed around and radially outwardly extended from the outer cylindrical surface of the separation roller and driving means for driving the separation roller.

According to a second aspect of the present invention, a document sheet feeder is characterized by comprising a document sheet stacker upon which are stacked a plurality of document sheets, separation means for separating a sheet at a time from the stack of sheets on the document sheet stacker, a feed roller disposed downstream of the separation means for feeding the sheet separated to a predetermined position, a pinch roller movable toward or away from the feed roller, first transfer means for transferring the separation means to a position at which the separation means carries out the separation of a sheet and a second transfer means for causing the pinch roller to contact with the feed roller, respectively, when the separation means is in its operation position.

According to the present invention, therefore, a plurality of sheets stacked on the document sheet stacker can be positively separated one at a time and fed to a predetermined position by the coaction between the inclined surface portion and the separation roller having a plurality of equiangularly-spaced-apart blades and being rotated by the driving means.

More particularly, upon rotation of the separation roller, at least one of loop-shaped, radially outwardly extended elastic blades of the separation roller is made to contact the uppermost sheet of the stack of sheets on the document sheet stacker. The elastic blades are formed in loop-shaped so that vibrations of the blades are eliminated and an impact noise can be avoided. Furthermore upon rotation of the separation roller, the each loop-shaped blade is deformed so as to increase in area of the surface of contact with a sheet and concurrently the pressure exerted to the sheet from the each loop-shaped blade is increased. As a result, the frictional force is increased so that the sheet can be securely fed without causing any slip between the sheet and each loop-shaped blade of the separation roller.

When the sheet is further moved so that the leading edge of the sheet reaches the inclined or tapered surface, the inclined surface and the loop-shaped blades of the separation roller cause the downward deflection of the sheet like a convex shape so that the complete separation of the sheet can be ensured.

The separated sheet is clamped between the downstream feed roller and pinch roller and is fed to a predetermined position. Then the first transfer means transfer the separation means to the inactive position and the pinch rollers are moved away from the feed roller by the second transfer means, so that the separation and feed operations are interrupted.

The above and other objects, effects, features and advantages of the present invention will become more apparent from the following description of embodiments thereof taken in conjunction with the accompanying drawings.

DESCRIPTION OF THE PREFERRED EMBODIMENTS

Figure 1:
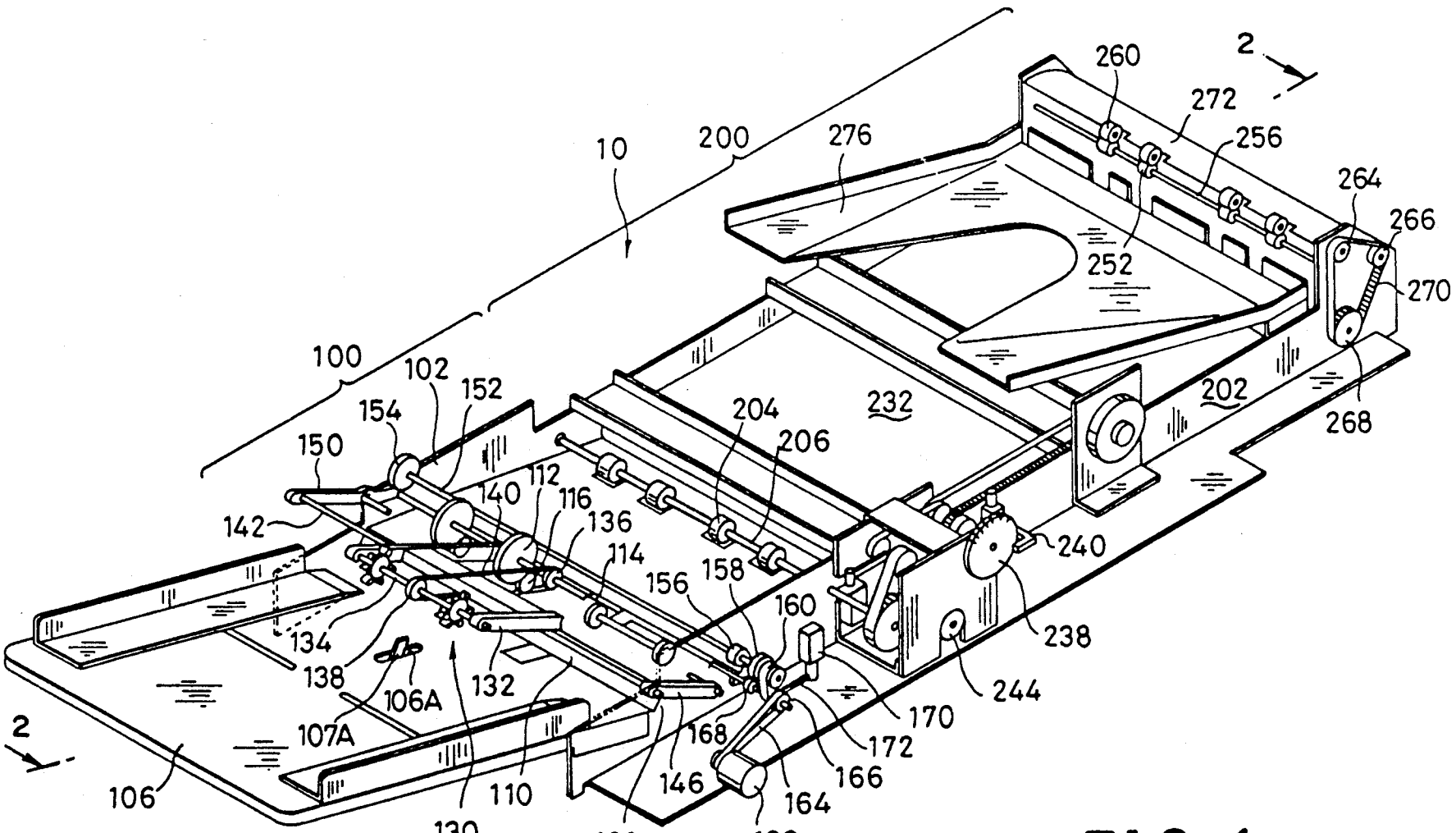
FIG. 1 shows an outer perspective view of a preferred embodiment of a document sheet feeder in accordance with the present invention.

FIGS. 1-7 show a preferred embodiment of a document sheet feeder in accordance with the present invention applied to an automatic document feeder (to be referred to as "ADF" hereinafter in this specification).

Reference numeral 10 designates an ADF main body mounted on a platen glass of a copying machine (not shown).

The ADF main body 10 may be generally divided into a sheet feeding unit 100 and a sheet transportation unit 200.

Figure 2:
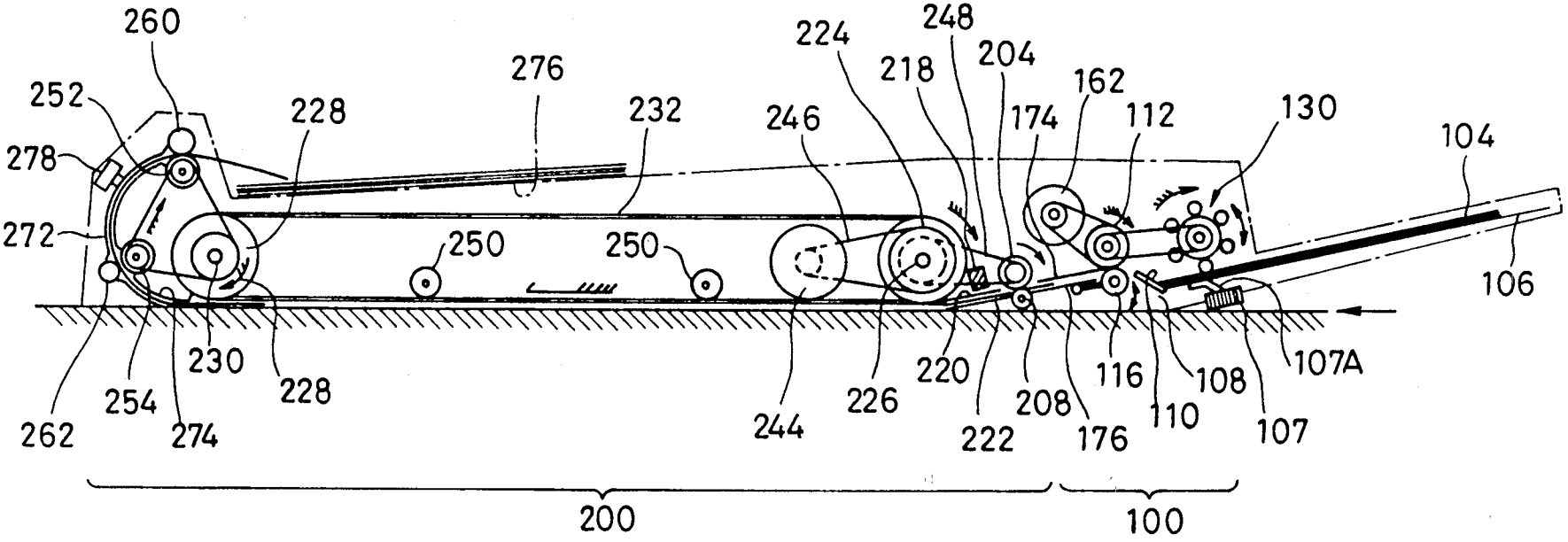
FIG. 2 is a schematic sectional view taken along the line A—A of FIG. 1.
Figure 3:
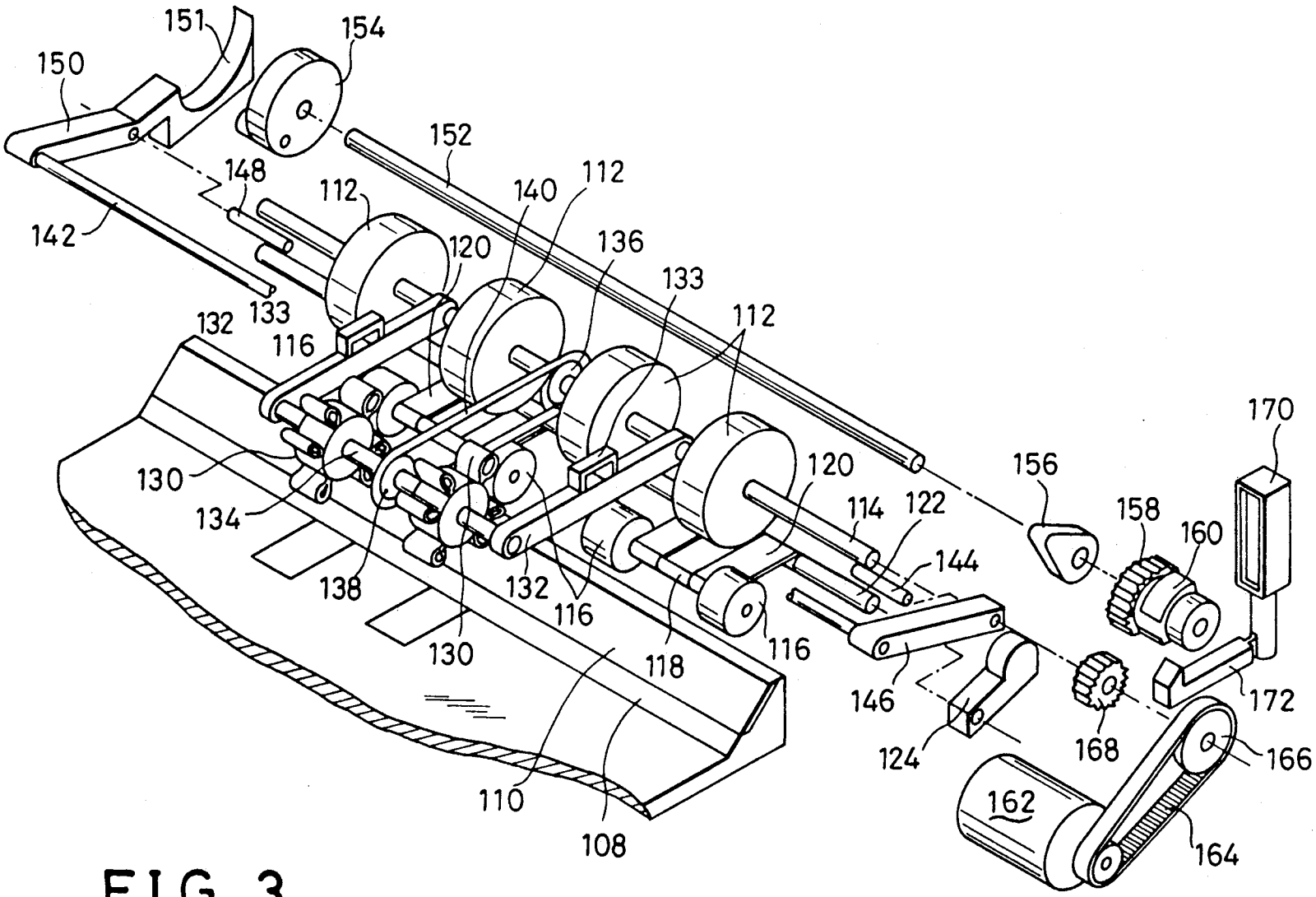
FIG. 3 is an exploded perspective view showing a major portion of a feeding unit of the preferred embodiment shown in FIG. 1.

Referring first to FIGS. 1-3, the sheet feeding unit 100 will be mainly described.

The sheet feeding unit 100 has frames 102 and a document sheet stacker 106 upon which are stacked a plurality of sheets 104 is extended from the outer ends of the frames 102. An actuating lever 107A of a feed sensor 107 is extended through hole 106A formed through the document sheet stacker 106. An inclined surface 108 is inclined at a predetermined angle between 25° and 35° and more preferably at 30° with respect to the document sheet stacker 106 and a separating plate 110 made of silicone rubber or the like is bonded over the inclined surface 108.

Feed rollers 112 are carried by a rotating shaft 114 rotatably supported by the frames 102 and are made to contact with pinch rollers 116, respectively, which in turn are carried by a stationary shaft 118 at opposite ends thereof, respectively. The stationary shaft 118 is connected through swinging arms 120 to a driving shaft 122 rotatably supported by the frames 102. A cam follower 124 is carried by the driving shaft 122 at one end thereof (See FIG. 3).

Separation rollers 130 to be described in more detail hereinafter are carried by a rotating shaft 134 whose both ends are rotatably supported by swinging arms 132, respectively. The end of each swinging arm 132 is rotatably mounted on the rotating shaft 114.

The rotating shafts 114 and 134 carry pulleys 136 and 138, respectively, which are drivingly coupled to each other through an endless driving belt 140.

A guide 133 with an elongated slot is defined at the upper surface of each swinging arm 132 and a driving rod 142 is extended through the elongated slots of the guides 133. One end of the driving rod 142 is attached to one end of a guide arm 146 which in turn is rotatably supported by the frame 102 with a pin 144 while the other end of the driving rod 142 is securely attached to one end of a driving arm 150 whose mid-point is rotatably supported by the frame 102 with a pin 148. The other end of the driving arm 150 terminates into a cam follower 151. One end of a supporting shaft 152 which is rotatably supported by the frames 102 carries a first cam 154 for engagement with the cam follower 151 while the other end of the supporting shaft 152 carries a second cam 156 for engagement with the cam follower 124, a gear 158 and a spring clutch 160.

A rotating shaft of a feed motor 162 is drivingly connected through an endless driving belt 164 to a pulley 166 carried by one end of the rotating shaft 114 and to a gear 168 in mesh with the gear 158. The spring clutch 160 is engaged or disengaged in response to the forward or backward movement of a hook 172 driven by a first solenoid 170.

Figure 4:
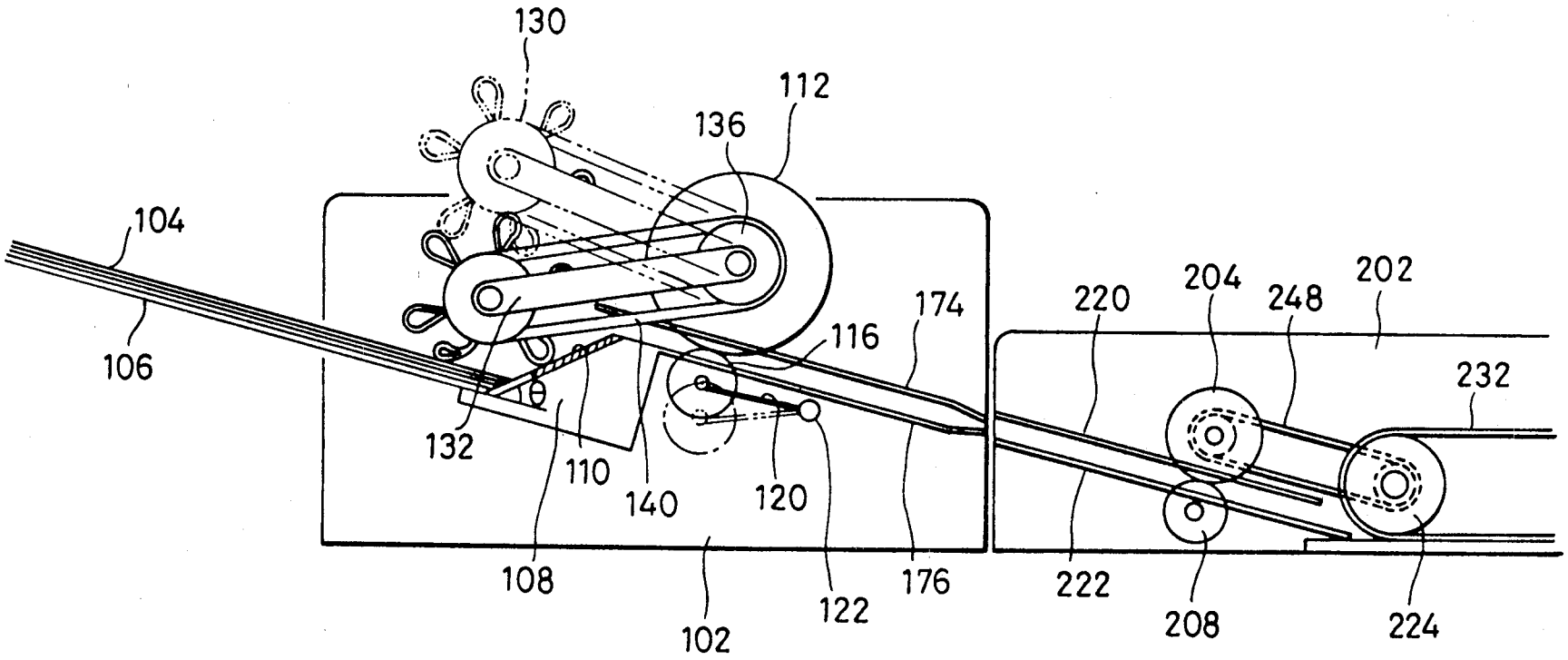
FIG. 4 is a side view used to explain the mode of operation of separation and pinch rollers.

An upper guide plate 174 and a lower guide plate 176 define a sheet feed passage (See FIG. 4).

Referring next to FIG. 5, the construction of the separation roller 130 will be described in detail.

The separation roller 130 comprises a roller main body 130B having six equiangularly-spaced-apart grooves 130A, elastic blades 130C each in the form of a loop and wheel caps 130D attached to both ends of the roller main body 130B.

Figures 5A, 5B, 5C:
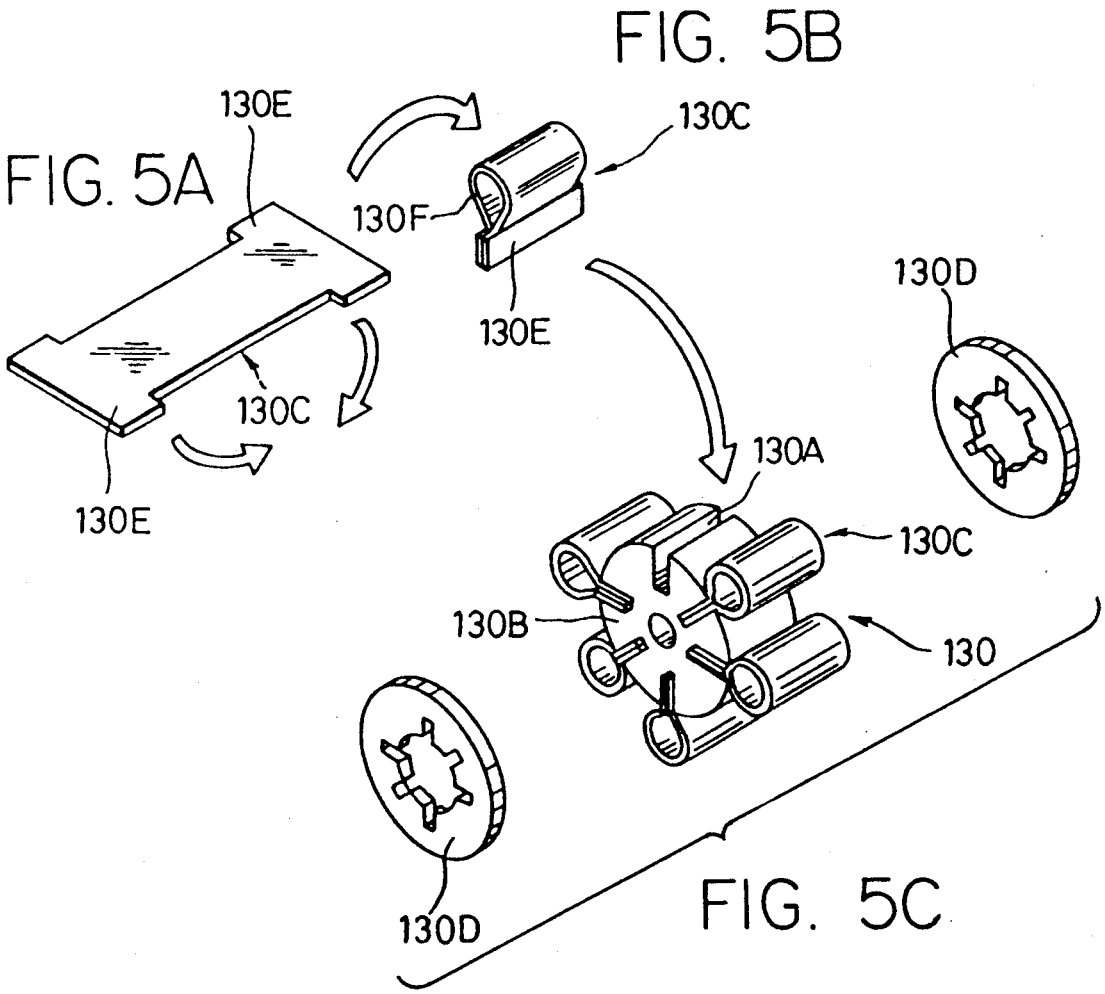
FIGS. 5A-C are perspective views used to explain the assembly of a separation roller.

According to the embodiment, a silicone rubber plate having ear portions 130E at opposite ends thereof as shown in FIG. 5A is shaped in such a way that the ear portions 130E are superposed one on the other, thereby forming the loop-shaped portion 130F as shown in FIG. 5B. Thereafter the superposed ear portions 130E are inserted into each of the grooves 130A of the roller main body 130B as shown in FIG. 5C.

Urethane rubber may be used to form the blades 130C, but the inventors found that the most preferable material is silicone rubber from the standpoint of low noise and separation and feeding capabilities.

Figure 6:
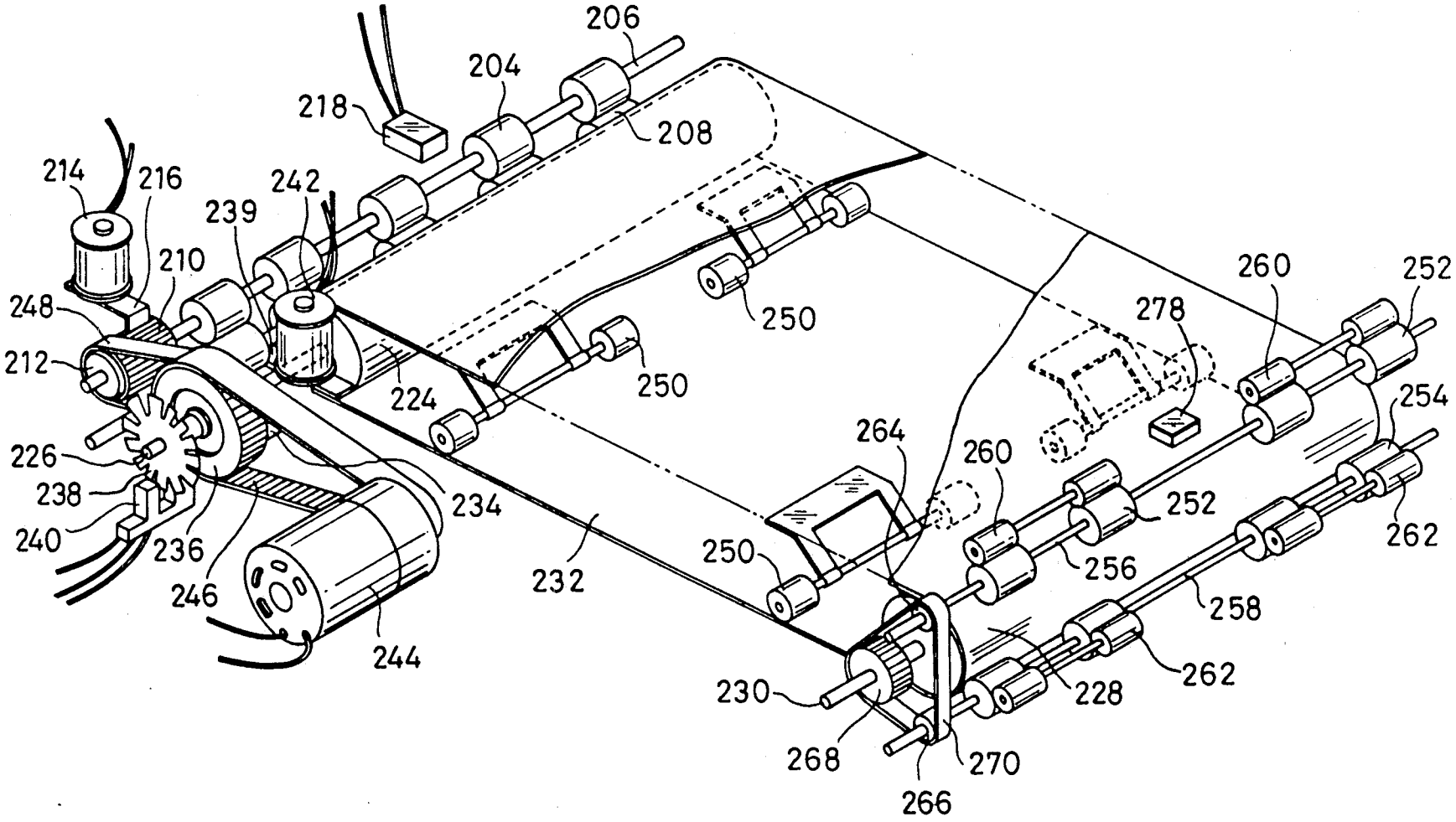
FIG. 6 is a perspective view showing a sheet transportation unit.

Referring next to FIGS. 1, 2, and 6, the sheet transportation unit 200 will be mainly described in detail.

The sheet transportation unit 200 has frames 202 which may be formed integral with the frames 102 of the sheet feeding unit 100.

Feed rollers 204 are carried by a rotating shaft 206 which in turn is rotatably supported by the frames 202 and pinch rollers 208 are adapted to be made into contact with their corresponding feed rollers 204. One end of the rotating shaft 260 carries not only a spring clutch 210 but also a sprocket 212 and the spring clutch 210 is adapted to be engaged with a hook 216 driven by a second solenoid 214 (See FIG. 6). A sheet sensor 218 is adapted to detect the leading edge of a fed sheet 104.

An upper guide plate 220 and a lower guide plate 222 define a sheet transportation passage (See FIG. 4). These guide plates 220 and 222 may be formed integral with the upper and lower guide plates 174 and 176 described above, respectively.

Referring especially to FIGS. 2 and 6, a first belt roller 224 is carried by a driving shaft 226 which in turn is rotatably supported by the frames 202 and a second belt roller 228 is carried by a driven shaft 230 and the first and second belt rollers 224 and 228 are drivingly coupled to each other through an endless transportation belt 232.

One end of the driving shaft 226 carries a spring clutch 234 and sprockets 236 and 237 (which is not shown because it is behind the sprocket 236) and an encoder disk 238 having a plurality of slits equiangularly spaced apart from each other by a suitable angle. The encoder disk 238 is inserted into a space defined in a photointerruptor 240 so that a light beam is intermittently interrupted.

A third solenoid 242 is adapted to cause a hook 239 to engage with the spring clutch 234.

A transportation motor 244 has its driving shaft coupled drivingly to the sprocket 236 through an endless driving belt 246 and the sprocket 212 is driven through a driving belt 248 and the sprocket 237.

Pressure rollers 250 are adapted to press the feed belt 232 against a platen glass of a copying machine (not shown).

Discharge rollers 252 and 254 are carried by rotating shafts 256 and 258, respectively, which in turn are rotatably supported by the frames 202. Pinch rollers 260 and 262 are made into contact with their corresponding discharge rollers 252 and 254, respectively.

One end of the rotating shaft 256 carries a sprocket 264 and one end of the rotating shaft 258 carries a sprocket 266. These sprockets 256 and 266 are driven through an endless transmission belt 270 by a sprocket 268 carried by one end of the driven shaft 230.

Curved guide plates 272 and 274 are adapted to reverse the discharged sheet so as to guide it into a discharge tray 276 (See FIG. 2).

A discharge sensor 278 is provided in order to detect the discharge of each sheet.

Figure 7:
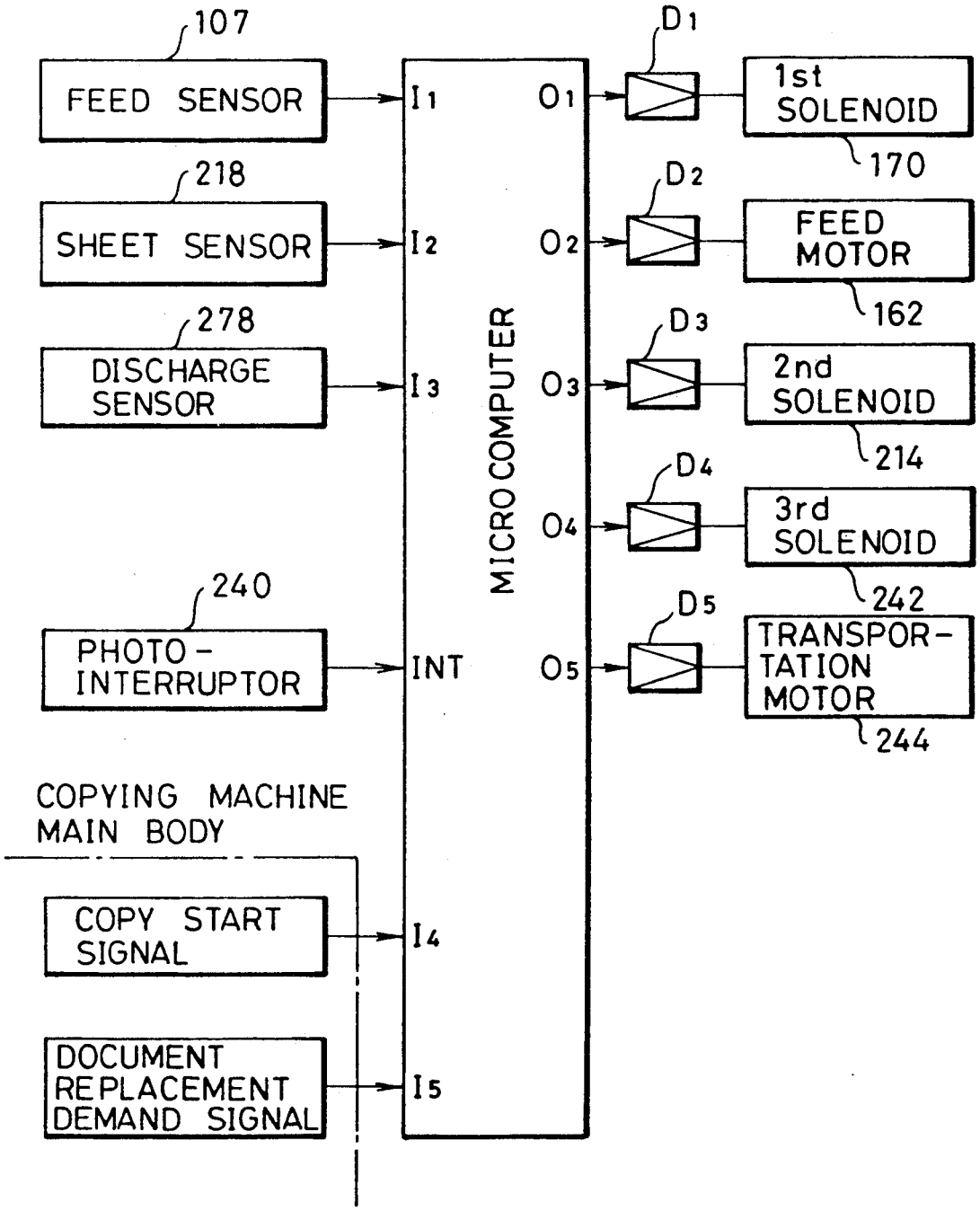
FIG. 7 is a block diagram illustrating a control circuit of the preferred embodiment shown in FIG. 1.

FIG. 7 illustrates a block diagram of a control circuit for carrying out the sequence control when the document sheet feeder in accordance with the present invention is applied to an ADF. Signals are exchanged between a conventional one-chip microcomputer incorporating therein ROMs, RAMs and so on and a controller of a copying machine main body whose major component parts are input and output buffers in order to carry out the sequential control.

The signals from the feed sensor 107, the sheet sensor 218 and the discharge sensor 218 and a copy operation start signal which is a command for activating this ADF as well as a document replacement demand signal for demanding the replacement of a sheet from a copying machine main body are applied to input ports $I_1$-$I_5$, respectively, of the microcomputer.

A signal from the photointerruptor 240 is applied to an offering (interruption) terminal INT and which represents a rotational speed of the first belt roller 224; that is, a reference clock for a quantity of a sheet to be transported and is counted by a counter incorporated within the microcomputer.

On the other hand, delivered from output ports $O_1$-$O_5$ of the microcomputer are energizing or de-energizing signals for energizing or de-energizing the first solenoid 170 for moving upwardly or downwardly the separation rollers 130 and the pinch rollers 116, the second solenoid 214 for starting or stopping the rotation of the feed rollers 204, the third solenoid 242 for starting or stopping the rotation of the first belt roller 224, the feed motor 162 and the transportation motor 244 through drivers $D_1$-$D_5$, respectively.

The read-in of these input signals or the output to each load is controlled by a program stored in the ROM incorporated in the microcomputer.

Next the mode of operation of the preferred embodiment with the above-describe construction will be explained. When a plurality of document sheets are stacked on the document sheet stacker 106, the actuating lever 107A of the feed sensor 107 is inclined so that the sensor 107 delivers a set signal. Then the feed motor 162 is energized and the first solenoid 170 is also energized so that the hook 172 is disengaged from the spring clutch 160. The rotation of the gear 168 is transmitted through the gear 158 to the first and second cams 154 and 156 in such a way that the cams 154 and 156 make one half rotation (that is, they rotate through 180°).

Upon one half rotation of the first cam 154 engaged with the cam follower 151, the driving arm 150 is caused to rotate about the pin 148 so that the driving rod 142 forces the swinging arms 132 downwardly, whereby as shown in FIG. 4 the separation rollers 130 are forced to move downwardly.

Upon one half rotation of the second cam 156, the pinch rollers 116 are forced to move upwardly so as to make into contact with the feed rollers 112 through the cam follower 124, the driving shaft 122 and the swinging arms 120. Under these conditions, the first solenoid 170 is de-energized so that the hook 172 is caused to engage with the spring clutch 160 and consequently the transmission of power from the gear 158 to the supporting shaft 152 is interrupted. As a result, the rotation of the first and second cams 154 and 156 is stopped. The separation rollers 130 are driven through the rotating shaft 114 and the endless driving belt 140 by the feed motor 162 so that the uppermost sheet of the stack of sheets on the stacker 106 is forced to move toward the inclined surface 108 by frictional forces of the blades 130C each in the form of a loop. In this case the loop-shaped blades 130C are made to abruptly in contact the uppermost sheet, but unlike the semi-cylindrical blades, the leading edge of each blade 130C is maintained in the form of a loop so that even when the loop-shaped blades 130C are made to abruptly contact the uppermost sheet, no vibration occurs and the impact noise can be suppressed.

Furthermore according to the preferred embodiment of the present invention, each separation roller 130 has six blades 130C so that at least one of them is always made into contact with the sheet 104 so that the vertical vibration of the separation rollers 130 can be reduced. As far as the condition that at least one blade 130C of each separation roller 130 is made to contact the sheet 104, it is possible to reduce the number of the blades 130C. For instance, each separation roller may have four loop-shaped blades. In addition, as far as the interference between the adjacent loop-shaped blades can be prevented, each separation roller may have eight loop-shaped blades.

According to the rotation of each separation roller 130, because of the symmetrical shape of the loop-shaped blades 130C, each loop-shaped blade 130C is caused to deflect and deform in the direction opposite to the direction of the rotation of each separation roller as best shown in FIG. 4. As a result, the surface of contact of each loop-shaped blade 130C with the sheet 104 is increased in area and furthermore due to the elastic deformation of the loop-shaped blade 130C, the frictional force is increased so that the slip between the separation rollers 130 and the sheet 104 can be prevented.

As the rotation of the separation rollers 130 continues, the leading edge of the sheet 104 reaches the inclined surface 108. While a leading portion of the sheet 104 is supported by the inclined surface 108 and the document sheet stacker 106, the center portion of the leading portion of the sheet 104 is pressed downwardly by the loop-shaped blades 130C so that the sheet 104 is deflected downwardly into a concave state. Therefore the separation of the uppermost sheet 104 can be positively carried out by the so-called "skillful manipulation". In order to attain such effect, it is preferable that the axis of rotation of each separation roller 130 is located within a plane which includes the joint between the inclined surface 108 and the document sheet stacker 106 perpendicular to the upper surface of the document sheet stacker 106 or adjacent the plane. Furthermore according to the present embodiment, the separation plate 110 made of silicone rubber is bonded over the inclined surface 108 so that the positive separation is ensured.

The more acute the angle of inclination $\theta$ of the inclined surface 108 with respect to the upper surface of the document sheet stacker 106, the more easily the separation of the uppermost sheet 104 becomes, but the feeding capability is degraded.

According to the results conducted by the inventors, for various sheets different in thickness and size, the angle $\theta$ which can attain satisfactory separation and feed capabilities is between 25° and 35° and more preferably 30°.

The sheet thus separated is further bent when its leading edge is made into contact with the guide plate 174 and is clamped between the feed roller 112 and the pinch rollers 116 and fed.

Meanwhile in the sheet transportation unit 200, the transportation motor 244 is energized concurrently with the output of the copy start signal. When it is detected by the sheet sensor 218 that a sheet 104 has not yet supplied, the second solenoid 214 is energized to engage the spring clutch 210 by the hook 216 so that the feed rollers 204 and the pinch rollers 208 are rotated to wait for the supply of a sheet.

When the separated sheet 104 is fed by the feed rollers 112 and the pinch rollers 116 and reaches the feed rollers 204 and the pinch rollers 208 so that the supply of the separated sheet is detected by the sheet sensor 218, the first solenoid 170 is energized to operate the spring clutch 160 so that the first and second cams 154 and 156 are rotated by one half of rotation again. Consequently the separation rollers 130 are moved upwardly while the pinch rollers 116 are moved downwardly, whereby the separation and feed of the sheet are interrupted. The above-described state is maintained until the generation of a document replacement demand signal.

In this case, even when the rotational speed is different between the feed rollers 112 and 204 so that the sheet slacks, nipping by the pinch rollers 116 is released so that the sheet can be prevented from being wrinkled.

Concurrently, in the sheet transportation unit 200, in response to the detection of the sheet arrival, the second solenoid 214 is de-energized to disengage the spring clutch 210 so that the feed rollers 204 and the pinch rollers 208 are stopped to hold the sheet.

In response to the output from the copying machine of the document replacement demand signal, the second and third solenoids 214 and 242 are concurrently energized so that the hooks 216 and 239 are moved upwardly, whereby the spring clutches 210 and 234 are engaged. As a result, the transportation motor 244 rotates the feed rollers 204, the pinch rollers 208 and the first belt roller 224.

In unison with the rotation of the first belt roller 224, not only the transportation belt 232 but also the discharge rollers 252 and 254 are driven so that when a sheet remains on the platen glass (not shown), the sheet is discharged into the discharge tray 216 and then the sheet in a waiting state is fed over the platen glass (not shown).

When the sheet which is in the waiting state between the feed and pinch rollers 204 and 208 is fed, the pinch rollers 116 are in their downward positions, respectively, so that the nipping is released. As a result, the contact pressure of each pinch roller 208 is not needed to increase unnecessarily.

The amount of the feed of the sheet by the transportation belt 232 is obtained by the number of rotations of the encoder disk 238 which in turn is converted into the number of pulses delivered from the photointerruptor 240 and the number of pulses is counted by a counter incorporated in the microcomputer. When the sheet is fed by a predetermined distance; that is, when the sheet is fed to a predetermined position, the third solenoid 242 is de-energized to disengage the spring clutch 234 so that the rotation of the first belt roller 224 and thus the driving of the transportation belt 232 are interrupted.

In this case, the rotation of the feed rollers 204 continues to wait for the feed of the next sheet. When the arrival of the next sheet is detected by the sheet sensor 218 in the manner described above, the feed rollers 204 are stopped so that the sheet remains in the waiting state.

When the feed sensor 107 detects that there remains no sheet on stacker 106 in the sheet feed unit 100, the separation rollers 130 are moved upwardly while the pinch rollers 116 are moved downwardly concurrently and then the feed motor 162 is de-energized.

In the sheet transportation unit 200, when the discharge sensor 278 detects that all the sheets have been discharged, the transportation motor is de-energized.

In the preferred embodiment of the present invention described above, each separated sheet is fed to and temporarily remains at the waiting position so that while the preceding sheet is being copied, the pre-handling of the succeeding sheet has been accomplished. As a result, the practical processing time can be shortened.

In addition means for interrupting the feed of each sheet is not needed to use a special clutch or the like and the nipping of a sheet can be released only by moving the pinch rollers downwardly. Therefore the document sheet feeder in accordance with the present invention can be simplified in construction and manufactured at less costs.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A document sheet feeder comprising:

a document sheet stacker upon which are stacked sheets;

an inclined surface portion inclined at a predetermined angle with respect to said document sheet stacker;

a separation roller which is disposed above said document sheet stacker and which has a plurality of loop-shaped blades which are equiangularly spaced apart from each other by a suitable angle and radially outwardly extended from the outer surface of said separation roller; and driving means for driving said separation roller.

2. A document sheet feeder as claimed in claim 1, wherein the angle of inclination of said inclined surface portion with respect to said document sheet stacker is between 25° and 35°.

3. A document sheet feeder as claimed in claim 2, wherein an elastic separation plate is bonded over the upper surface of said inclined surface portion.

4. A document sheet feeder as claimed in claim 3, wherein said elastic separation plate is made of silicone rubber.

5. A document sheet feeder as claimed in claim 1, wherein said separation roller comprises:

a roller main body with a plurality of equiangularly-spaced-apart grooves extended in parallel with the axis of said roller main body; and a plurality of blades each of which is shaped from an elastic plate in such a way that each blade is in the form of a loop between the end portions thereof which are superposed one over the other and are inserted into each of said grooves.

6. A document sheet feeder as claimed in claim 5, wherein the axis of rotation of said separation roller is located within a plane which includes a joint between an upper surface of said document sheet, stacker and said inclined surface portion, said plane being perpendicular to said upper surface of said document sheet stacker.

7. A document sheet feeder as claimed in claim 5, wherein said elastic plate is a silicone rubber plate.

8. A document sheet feeder as claimed in claim 5, wherein said separation roller has from four to eight blades.

9. A document sheet feeder as claimed in claim 5, wherein the axis of rotation of said separation roller is located in the vicinity of a plane which includes a joint between an upper surface of said document sheet stacker and said inclined surface portion, said plane being perpendicular to said upper surface of said document sheet stacker.

10. A document sheet feeder comprising:

a document sheet stacker adapted to receive a stack comprising a plurality of sheets;

separation means for separating a sheet from a stack of sheets on said document sheet stacker, said separation means comprising an inclined surface portion inclined at a predetermined angle with respect to said document sheet stacker and a separation roller which is disposed above said document sheet stacker and which has a plurality of loop-shaped elastic blades;

a feed roller disposed downstream of said separation means for feeding a separated sheet to a predetermined position;

a pinch roller movable to engage with or disengage from said feed roller;

first transfer means for displacing said separation means to its operative position at which said separation means performs its separation operation; and second transfer means for displacing said pinch roller so as to engage with said feed roller when said separation means is disposed to and maintained in said operative position by said first transfer means.

11. A document sheet feeder as claimed in claim 10, wherein the angle of inclination of said inclined surface portion with respect to said document sheet stacker is between 25° and 35°.

12. A document sheet feeder as claimed in claim 11, wherein a separation plate made of an elastic material is bonded over the upper surface of said inclined surface portion.

13. A document sheet feeder as claimed in claim 12, wherein said elastic material is a silicone rubber.

14. A document sheet feeder as claimed in claim 10, wherein said separation roller comprises a roller main body which has a plurality of equiangularly-spaced-apart and radially extended grooves and a plurality of blades each of which is made of an elastic plate which is shaped to make a loop between the ends thereof which in turn are inserted into each of said grooves.

15. A document sheet feeder as claimed in claim 14, wherein the axis of rotation of said separation roller is located within a plane which includes a joint between an upper surface of said document sheet stacker and said inclined surface portion, said plane being perpendicular to said upper surface of said document sheet stacker.

16. A document sheet feeder as claimed in claim 14, wherein said elastic plate is a silicone rubber plate.

17. A document sheet feeder as claimed in claim 14, wherein said separation roller has from four to eight blades.

18. A document sheet feeder comprising:

a frame a document sheet stack plate which is securely fixed to said frame and whose base portion is in the form of an inclined surface inclined at a predetermined angle with respect to a surface of said document sheet stack plate, a feed roller mounted on a first shaft rotatably supported by said frame in order to feed a sheet to a predetermined position;

a first swinging arm which is swingably carried by said first shaft in such a way that said first swinging arm can swing about said first shaft and whose leading end rotatably carries a second shaft;

a separation roller which is mounted on said second shaft and which has a plurality of angularly spaced-apart blades which are extended radially outwardly from the outer surface of said separation roller, first driving means for rotating said feed roller and said separation roller in the same direction;

a second swinging arm which is mounted on a third shaft supported rotatably by said frame in such a way that said second swinging arm can swing about the axis of said third shaft and whose leading end rotatably carries a pinch roller;

second driving means for moving said first swinging arm to a position at which said separation roller approach said document sheet stack plate for carrying out a sheet separation operation and retracting said first swinging arm to an inoperative position spaced apart from said document sheet stack plate by a suitable distance; and third driving means for moving said second swinging arm between a position at which said pinch roller is made into contact with said feed roller and a position at which said pinch roller is moved away from said feed roller.

19. A document sheet feeder as claimed in claim 14, wherein the axis of rotation of said separation roller is located in the vicinity of a plane which includes a joint between an upper surface of said document sheet stacker and said inclined surface portion, said plane being perpendicular to said upper surface of said document sheet stacker.

* * * * *